United States Patent [19]

Hunsicker

[11] 4,169,453

[45] Oct. 2, 1979

[54] COMPOUND SLINGSHOT

[75] Inventor: Glen G. Hunsicker, Topeka, Kans.

[73] Assignee: Dory J. Neale, Sr., Topeka, Kans. ; a part interest

[21] Appl. No.: 839,013

[22] Filed: Oct. 3, 1977

[51] Int. Cl.[2] ..... F41B 3/00

[52] U.S. Cl. ..... 124/20 R; 124/41 A; 124/61; 124/80; 124/16

[58] Field of Search ..... 124/20 R, 35 R, 41 R, 124/25, 1, 22, 23 R, 24 R, 16, 29, 17, 31, 80, 88, 90; 273/260

[56] References Cited

U.S. PATENT DOCUMENTS

| | | | |
|---|---|---|---|
| 1,153,415 | 9/1915 | Beaty | 124/1 |
| 2,307,021 | 1/1943 | Cordrey et al. | 124/22 UX |
| 3,509,863 | 5/1970 | Barker | 124/31 X |
| 3,599,621 | 8/1971 | Scrobell | 124/88 X |
| 3,804,072 | 4/1974 | Izuta | 124/89 X |
| 3,851,638 | 12/1974 | Alexander | 124/90 X |
| 3,993,039 | 11/1976 | Groves et al. | 124/23 R |

*Primary Examiner*—Richard C. Pinkham
*Assistant Examiner*—William R. Browne
*Attorney, Agent, or Firm*—Fishburn, Gold & Litman

[57] ABSTRACT

A compound slingshot comprises a longitudinally extending support shaped for holding by a user, an elongate resilient member having one end attached to the support, and a cam rotatably mounted on the support and having an eccentric marginal surface. A flexible line has one end connected with the free end of the resilient member, and the other end attached to and wound about the marginal surface of the cam. A projectile receiver is operably connected with the cam by a second flexible line, whereby rearward translation of the receiver with respect to the support rotates the cam and tenses the resilient member in such a manner that the force required to retain the receiver at a fully extended position is less than the force required to retain the receiver at an intermediate position thereby providing accurate aiming of the slingshot and increased hurling capabilities.

10 Claims, 9 Drawing Figures

COMPOUND SLINGSHOT

This invention relates to mechanical projectors and, more specifically, to a compound slingshot.

The sling is an ancient apparatus, which beget the modern slingshot. The standard modern slingshot typically consists of a forked handle with elastic bands attached to the forks and a projectile receiver pad. This standard or conventional slingshot while adequate for some purposes, nevertheless, has some major limitations. The maximum force which can be applied to the projectile of the conventional slingshot is directly proportional to the strength of the user. Hence, velocity, distance, and impact power are limited by the physical abilities of the user. The force required to retain the receiver in a fully drawn position normally requires all available strength of the user, creating an unstable state in which muscles and hence the slingshot wobble, making it difficult to control and aim the slingshot. The projectile used with the conventional slingshot must be surrounded by the receiver pad, thus elongated objects such as arrows and the like cannot be shot therefrom, and the elastic bands of conventional devices are easily broken.

The principal objects of the present invention are: to provide a compound slingshot having a cam mechanism for imparting greater velocity, inertia, distance, and impact power to a projectile hurled therefrom; to provide such a cam mechanism for reducing the force required to retain the receiver at a fully extended position while still imparting the same energy to the projectile for superior control in aiming; to provide such a compound slingshot having a detachable support for hurling elongate projectiles; to provide such a slingshot having interchangeable energy storage devices; to provide such a slingshot having a pulley mechanism operably connected with the cam and providing additional mechanical advantage for reducing the required drawing or cocking force; to provide such a device having resilient means with adjustable tension to correspond to the physical strength of the user and accomodate the same; and to provide such a compound slingshot which is capable of an extended useful life and is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figures 1, 4:
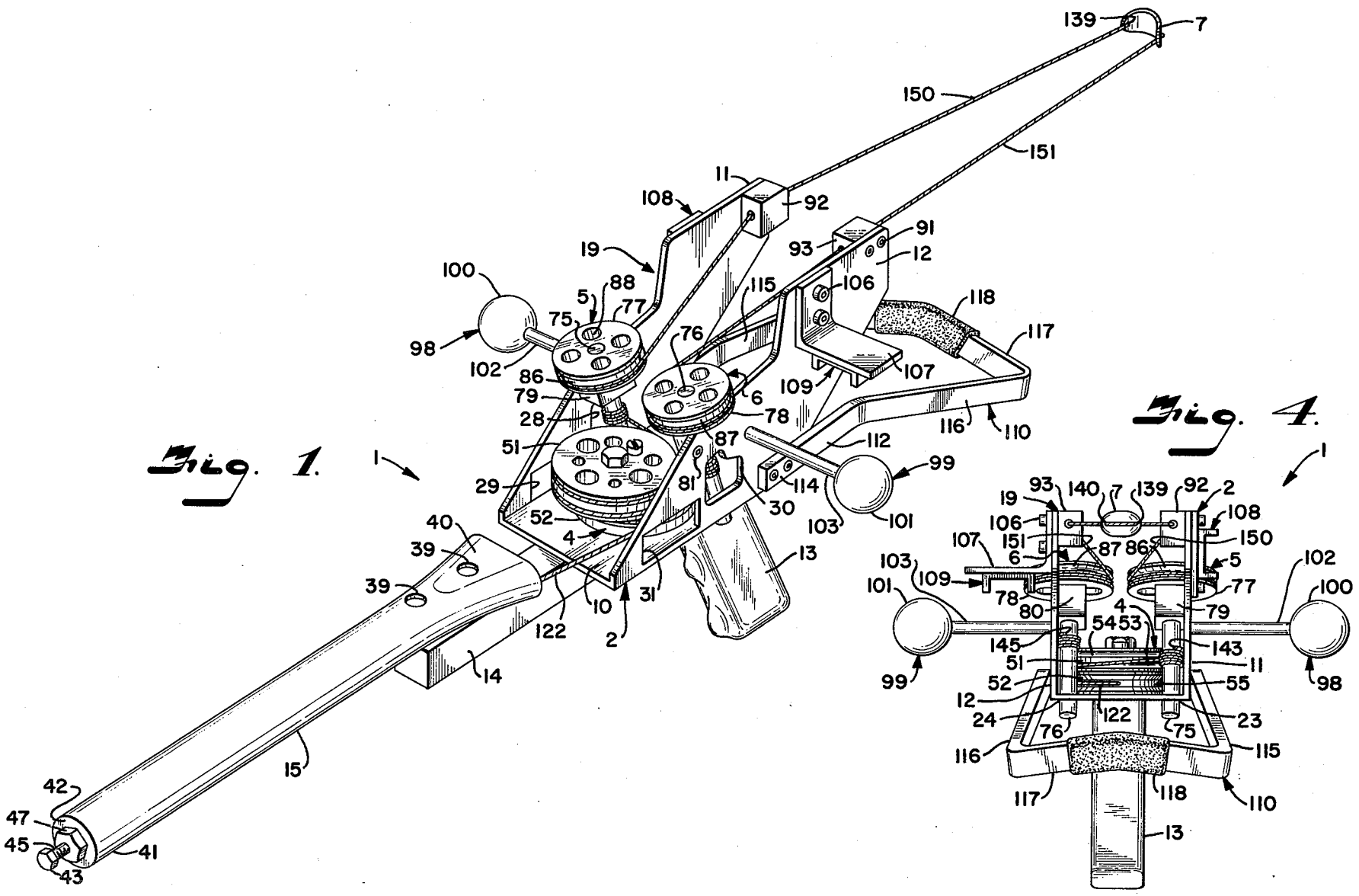
FIG. 1 is a perspective view of a compound slingshot embodying the present invention and being shown in half-drawn position.
FIG. 4 is a rear elevational view of the slingshot in the half-drawn position.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 generally designates a compound slingshot. The compound slingshot 1 includes a longitudinally extending support member 2 adapted to be held by a user, an elongate resilient means 3 connected to the support member 2, a cam 4 rotatably connected to the support member 2 and operatively connected to the resilient means 3. A pair of mechanical advantage members 5 and 6 are connected to the support member 2 and are operatively connected to the cam 4 and a projectile receiver 7.

The support member 2 may be any suitable structure capable of being held by the user and having sufficient strength to support the members mounted thereon without bending or warping. In the illustrated embodiment, the support member 2 includes a base 10, a pair of side panels 11 and 12 extending upwardly from the base 10, a handle 13 depending downwardly from the base 10, a forwardly extending beam 14, and a housing 15 supported by the beam 14 and retaining the resilient means 3 therein.

For purposes of description, the comparative location of the receiver 7 is considered to be on the back side of the compound slingshot, and the right side of the slingshot is considered to be in relation to one standing behing the receiver 7 and looking forward at the apparatus. In the illustrated support 2, the base 10 and the side panels 11 and 12 form one continuous U-shaped frame 19. The base 10 is rectangular in configuration and essentially uniform in thickness. The base 10 has a series of openings for receiving various members mounted thereon, including: two openings (not shown) located frontwardly on the base 10 and centered between the sides thereof for receiving fasteners 20 for the beam 14; an opening 22 located directly behind the last mentioned openings and being shaped for receiving a bolt 26 which is both a support and a fastener for the cam 4; and two openings 23 and 24 located adjacent to the sides of the base 10 and medially between the front and the back edges of the base 10 for receiving rotating members of the mechanical advantage devices 5 and 6. The openings 23 and 24 are canted forwardly at the top at an angle in the nature of 15° with the vertical for purposes which will be hereinafter explained.

The side panels 11 and 12 are disposed longitudinally and vertically with respect to the base 10, and are substantially parallel with respect to one another. The side panels 11 and 12 are attached along their lower edge to the right and left sides respectively of the base 10, and are upwardly extending therefrom. The side panels 11 and 12 serve as a support for several members of the apparatus which will be subsequently discussed, and are also provided with several openings, which include windows 28 and 29 in panel 11, and 30 and 31 in panel 12. These windows allow working access to the members mounted on the frame 19 and reduce the weight of the apparatus. The windows 29 and 31 also specifically allow clearance for the cam 4 as it rotates. The side panels 11 and 12 have all excess structure removed, thus a triangular piece is removed from the lower rear portion of, a second triangular piece from the upper front portion of, and a rectangular section from the upper middle portion of each panel 11 and 12 where the pieces are not needed for support, and if present, would hamper movement of other members of the device such as the mechanical advantage members 5 and 6.

The handle 13 depends downwardly from the base at a point thereon disposed slightly to the rear of the center thereof. The handle 13 is secured to the base 10 by hex-head, countersunk screw fasteners 21, and is canted rearwardly at the bottom at an angle of approximately 25° with the vertical to anatomically accommodate the angle of grip of the hand of the user. The handle 13 is contoured to comfortably conform to the shape of the hand of the typical user.

The support beam 14 is a rigid structure which extends forwardly of the base 10 and is fastened to the same by suitable means such as welding, bolting, or screwing, and in the present embodiment by bolts 20 received through the openings located at the front of and centered between the sides of the base 10 and the bolts 20 are secured by suitable fasteners to the base 10. The illustrated support beam 14 is rectangular in cross section and extends forwardly of the base 10 to support the housing 15 thereon.

Figure 2:
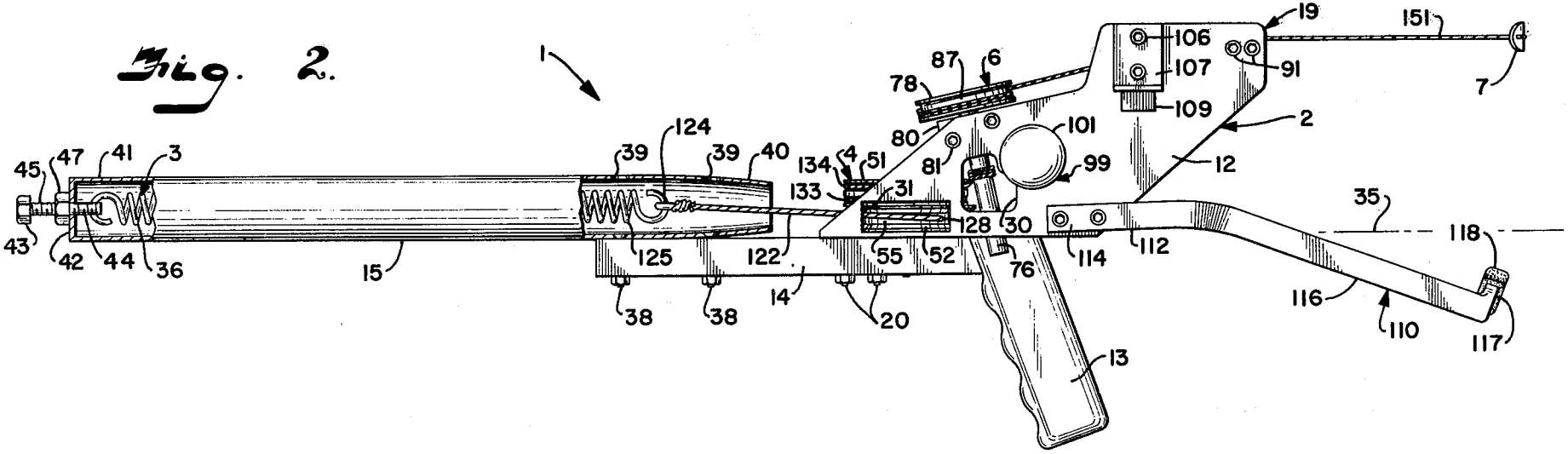
FIG. 2 is a side elevational view of the slingshot in a quarter-drawn position with portions broken away to show internal construction.
Figure 3:
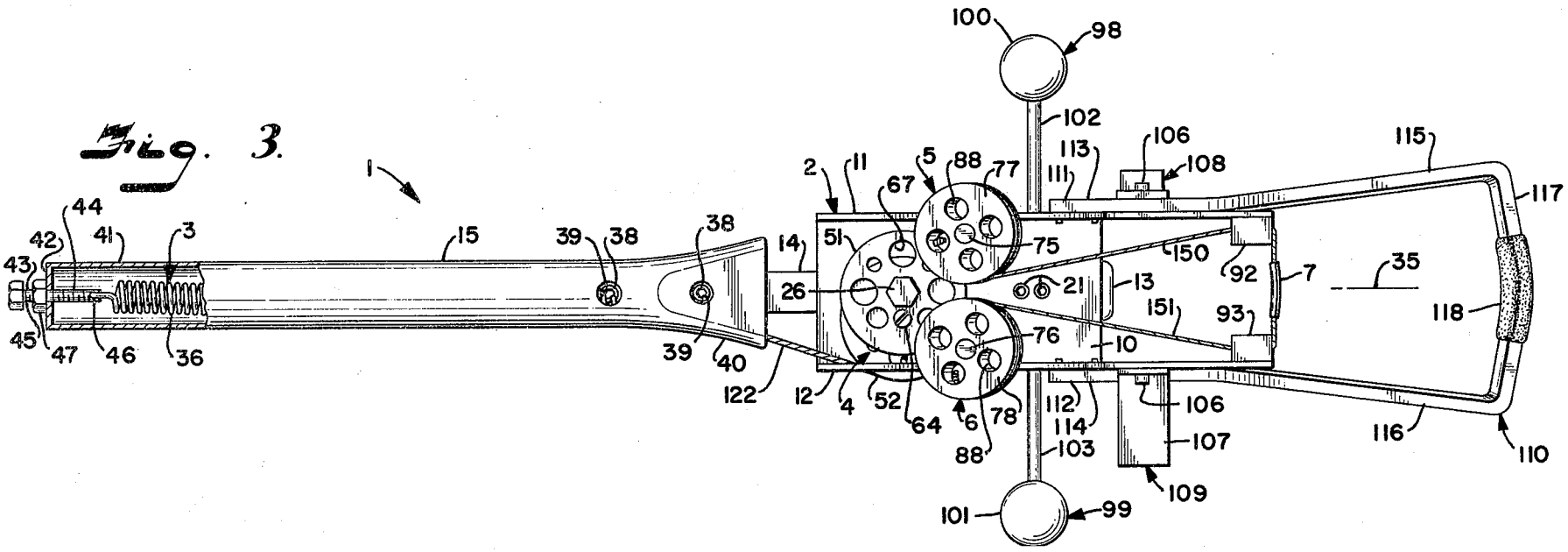
FIG. 3 is a top plan view of the slingshot in a relaxed position with portions thereof broken away.

The housing 15 extends forwardly of the base 10 and is aligned along the longitudinal axis 35 of the apparatus. In the embodiment illustrated in FIG. 2, the resilient means 3 comprises a coil spring 36 which is mounted in and protected by the housing 15. The housing 15 is a support for the distal end of the spring 36 and protects the user from getting hair or other body parts caught between the coils of the spring 36 and from the hazard of exposure to broken pieces should the spring 36 break. The housing 15 is attached to the support beam 14 by two flat hex-head or Allen type bolts 38 which are countersunk into the housing 15 to avoid interference with the spring 36. Openings 39 are provided in the top of the housing to allow ready access to the connecting bolts 38. The housing 15 also protects the spring 36 from being snagged on other members of the apparatus or pinching adjacent objects upon recoiling. The housing 15 is of a tubular construction with an inside diameter sufficiently large to allow the spring 36 lateral movement therein. The rearward end 40 of the housing 15 is flattened somewhat to a generally ovate shape to provide a flanged effect when viewed from above. The flanged end 40 allows for additional sideways movement of the spring 36 and connecting flexible line member. The forward end 41 of the housing 15 is closed by a cap 42. A threaded set screw 43 is slidably mounted in the center of the cap 42. One end 44 of the screw 43 extends into the housing cap 42, and has a lateral opening 46 therethrough. The spring 36 is received in the opening 46 and bent back on itself so as to connect the spring 36 to the housing 15. The other end 45 of the screw 43 extends outside the housing cap 42 and has a means such as the illustrated nut 47 adapted for manipulation with a wrench to adjust tension on the spring 36.

The frame 19, the handle 13, the support beam 14, and the housing 15 may be constructed of any suitable material such as wood or steel and in the preferred embodiment all are constructed of aluminum which provides the required strength and yet is lightweight.

The spring 36 comprises an elongate resilient wound metallic coil. In the embodiment illustrated, the spring 36 is a cylindrical helical extension coil of regular cross section having a relatively high coefficient of extension. The coefficient of extension of the spring 36 is selected to correspond to the general physical abilities of a selected class of users.

Figure 6:
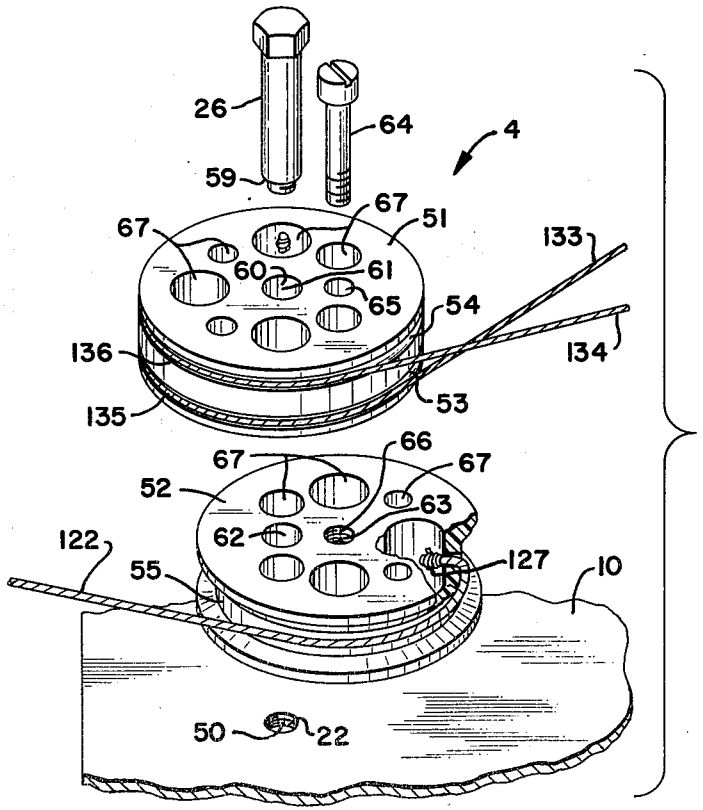
FIG. 6 is an enlarged, fragmentary, exploded view of the slingshot showing a cam member thereof.

As best seen in FIG. 6, the cam 4 is rotatably mounted on the base 10 at a point 50 which is located on the top side of the base 10 and which corresponds to the center of the opening 22 for the shaft or bolt 26 upon which the cam 4 rotates. The bolt 26 also secures the cam 4 to the base 10. The cam 4 has concentric and eccentric marginal surfaces. In the embodiment illustrated, the concentric surface is formed on a reel or pulley 51 and the eccentric surface is formed on a reel or pulley 52. The pulleys 51 and 52 are cylindrically shaped and of substantially the same diameter. The pulley 51 has two channels 53 and 54 circumferentially embedded in its outer marginal or peripheral surface, and the pulley 52 has one similar channel 55 for facilitating the winding of line around the pulleys 51 and 52. The illustrated cam 4 has a two-part construction wherein the eccentric pulley 52 forms a bottom portion of the cam 4 and the concentric pulley 51 forms a top portion thereof. The cam connecting bolt 26 is threaded at its lowermost end for a distance slightly greater than the thickness of the base 10, and the threads are of a diameter somewhat smaller than the unthreaded portion of the bolt 26, thereby forming a shoulder or lip 59 which abuts the base 10 when the bolt 26 is inserted in the same. The opening 22 in the base 10 is threaded with a thread corresponding to that of the bolt 26 to receive and secure the same to the base 10 in a substantially perpendicular orientation thereto. A smooth shaft portion of the bolt 26 passes through an opening 60 in the pulley 51, disposed concentrically with an axis 61 of the pulley 51, and also through an opening 62 in the pulley 52 which is parallel to an axis 63 of the pulley 52 and which opening is located at an intermediate distance between the center and outer periphery of the pulley 52. The openings 60 and 62 are of substantially the same diameter as the shaft portion of the bolt 26, but with sufficient clearance to allow rotation of the pulleys 51 and 52 about the bolt 26. A threaded opening 66 is disposed concentrically with the center 63 of the pulley 52. A threaded bolt 64 of the same diameter as the opening 66 extends through an opening 65 in the pulley 51 and is received in the opening 66. The distance separating the openings 60 and 65 is equal to the distance separating the openings 62 and 66, such that the openings 60 and 62 are aligned and the openings 65 and 66 are aligned when the bolts 26 and 64 are secured in their normal respective positions in the openings. Thus, the bolts 26 and 64 fixedly interconnect the pulleys 51 and 52 for rotation with each other, whereby the pulley 51 rotates concentrically about point 50, and the pulley 52 rotates eccentrically thereabout. Additional regularly and circumferentially spaced circular openings 67 are disposed in the pulleys 51 and 52 and are positioned substantially parallel to the axis of rotation of the cam 4, and reduce the weight and moment of inertia of each pulley.

The mechanical advantage means or members 5 and 6 are operatively connected with the cam 4 and each member comprises a shaft 75 and 76 having a reel or pulley 77 and 78 respectively connected therewith. The shafts 75 and 76 have lower ends which are rotatably mounted in openings 23 and 24 respectively in the base 10, and the shafts extend upwardly from the base 10 to a point above the side panels 11 and 12. The shafts 75 and 76 are of substantially coextensive length and diameter. The shafts 75 and 76 are canted forwardly from the bottom toward the top at an angle in the nature of 15° with the vertical. The pulleys 77 and 78 are fixedly attached to the top of and rotate concentrically with the shafts 75 and 76 respectively, such that the pulleys 77 and 78 rotate above the side panels 11 and 12 at an angle in the nature of about 15° with the horizontal. Upper ends of the shafts 75 and 76 are rotatably mounted in bearing blocks 79 and 80, which are located centrally along the associated side panel 11 and 12, and adjacent the top edge thereof. The blocks 79 and 80 are securely attached to the side panels 11 and 12 by suitable fasteners such as hex-head countersunk screws 81. The pulleys 77 and 78 are cylindrical in shape, and of similar diameter and thickness. Each of the pulleys 77 and 78 has a channel 86 and 87 respectively, circumferentially positioned in its marginal or peripheral surface for facilitating the winding of line about the pulley. The pulleys 77 and 78 also have regularly and circumferentially spaced circular openings 88 oriented parallel to the axis of rotation of the associated pulley to reduce their weight and moment of inertia. The pulleys 77 and 78 are made of aluminum or other lightweight materials and in the embodiment illustrated they are plastic.

A pair of line guides 92 and 93 are attached by countersunk hex-head screws 91 to upward and rearward portions of the inner surface of the side panels 11 and 12 respectively. The line guides 92 and 93 each have an opening disposed generally parallel to the longitudinal axis 35 of the compound slingshot 1 which is suitably shaped for receiving a line therein, and is bevelled around the edges so as to reduce abrasion with the line.

A pair of counter balance weights 98 and 99 are attached to the outer surfaces of the side panels 11 and 12 respectively and extend laterally from a medial portion thereof. Each of the weights 98 and 99 comprises a spherically shaped, weighted ball 100 and 101 supported by a shaft 102 and 103 respectively. The shafts 102 and 103 are threadedly mounted on the side panels 11 and 12 respectively. The weights 98 and 99 extend laterally outwardly from the slingshot 1 a predetermined distance and increase its rotational moment of inertia.

A pair of sight brackets 108 and 109 are attached by hex-head screws 106 to the outer sides of and are rearwardly located on the side panels 11 and 12 respectively. The sight bracket 109 is mounted on an angle brace 107 perpendicular to the outer surface of side panel 12 and the sight bracket 108 is mounted parallel to the outer surface of side panel 11. The sight brackets 108 and 109 are shaped to mount any standard sighting device (not shown), and they are mounted such that the sight associated with bracket 108 (to the user's right side) is used when the base 10 of the compound slingshot 1 is horizontally positioned and sight associated with bracket 109 is used when the slingshot 1 is rotated clockwise on its axis 35 approximately 90° such that the base 10 is vertically positioned.

A rest 110 extends rearwardly from the lower portions of the side panels 11 and 12. The rest 110 is formed of one continuous piece of aluminum metal in the illustrated embodiment. Ends 111 and 112 of the rest 110 are attached by countersunk hex-head screws to the outer side of the side panels 11 and 12 respectively. Front portions 113 and 114 of each side of the rest 110 extend rearwardly from the ends 111 and 112 respectively parallel to the axis 35 of the slingshot and to the arm of the user. Rear portions 115 and 116 of each side of the rest 110 are continuous with and form obtuse angles with the front portions 113 and 114 respectively so as to approach the level of the arm of the user. A cross-member 117 connects rearward ends of the rear portions 115 and 116 and is positioned to anatomically brace against the upper side of the forearm of the user. The rest 110, in bracing against the arm of the user, counteracts any pivotal rotation of the compound slingshot 1 about its transverse axis caused by a force being applied to the receiver 7. A pad 118 is attached to the crossmember 117 so as to comfortably engage the user's arm.

Figure 5:
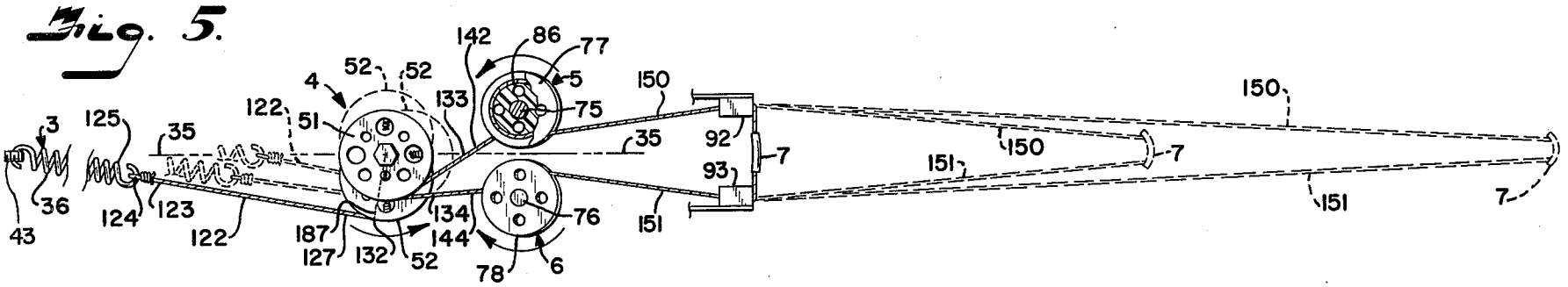
FIG. 5 is a partially schematic view of the slingshot showing the relaxed, the half-drawn, and a fully drawn position.

As best illustrated in FIG. 5, the spring 36, the cam 4, the mechanical advantage devices 5 and 6, and the receiver 7 are all interconnected by flexible line members. The spring 36 and the cam 4 are connected by a flexible line member 122. In this example, one end 123 of the line 122 has an eyelet 124 attached to the end 123. A rearward end 125 of the spring 36 is connected to the eyelet 124 by passing a coil of the spring 36 through the eyelet 124 and bending the coil back on itself. A second end 127 of the line member 122 is attached to the eccentric pulley 52 of the cam 4. The illustrated end 127 is inserted through a radial opening 128 in the pulley 52, which intersects one of the weight reduction openings 67, and has a second end 127 on the inner side to prevent the line from pulling out. When the compound slingshot 1 is in a position of rest, the cam's eccentricmost point 132 is disposed at a position 90° from the longitudinal axis 35 of the slingshot 1 and on the left side thereof. The longitudinal dimension of the line member 122 is such as to place pretension in the spring 36. As the cam 4 rotates counterclockwise from the rest position, the line member 122 will convolute or wind around the peripheral surface of the pulley in the channel portion 55.

The cam 4 is connected to the mechanical advantage devices 5 and 6 by separate line members 133 and 134. The line members 133 and 134 are connected with the marginal surface of the cam pulley 51 and wind or convolute around the cam pulley 51 in the same direction. In the embodiment illustrated, one end 135 of the right line 133 is attached to the concentric cam pulley 51 by insertion through an opening (not shown) and a knotted interior end. The illustrated line 133 is positioned in the lowermost channel 53 of the pulley 51. In a manner similar to right line 133, one end 136 of the left line 134 is positioned in the uppermost channel 54 of the pulley 51. A second end 142 of the line member 133 is attached to the shaft 75 by insertion through a diametrical opening 143 therein disposed intermediate of the top and bottom of the shaft 75 being knotted on the opposite side. A second end 144 of the line member 134 attaches to the shaft 76 by insertion through an opening 145 and knotting as just described for the line member 133. In the rest position maximum lengths of the line members 133 and 134 are wound around the concentric pulley 51 and a minimum around the shafts 75 and 76 respectively. Upon counterclockwise rotation of the cam 4, the line members 133 and 134 unwind from the channels 53 and 54. The line member 133 winds around the shaft 75 when it rotates counterclockwise and the line member 134 winds around the shaft 76 when it rotates clockwise.

The projectile receiver 7 is a flexible sheet member shaped for engaging a portion of a non-elongate projectile, and in the illustrated embodiment in FIGS. 1–6 comprises an elliptically shaped pad operatively connected to the mechanical advantage devices 5 and 6. The pad 7 is preferentially constructed of leather but may be other flexible material such as plastic or the like. The pad 7 has two openings 139 and 140 generally coinciding with the focii of its elliptical shape.

The receiver 7 and the mechanical advantage devices 5 and 6 are connected by line portions 150 and 151 respectively. One end 152 of the right-hand line portion 150 is attached to the pulley 77 by insertion in a diametrical opening (not shown) and knotting on the inner side thereof. The corresponding end 153 of left-hand line portion 151 is attached to pulley 78 in a like manner. The line portions 150 and 151 pass through and are held at a medial position along their lengths by the line guides 92 and 93 respectively. The line portions 150 and 151 pass through the openings 139 and 140 respectively in the receiver pad 7, and meet behind the receiver 7. As illustrated, the line portions 150 and 151 are segments of a single, continuous line member. In the rest position maximum lengths of line members 150 and 151 are wound around the channels 86 and 87 of the pulleys 77 and 78 respectively. The line member 150 unwinds when the pulley 77 is rotated counterclockwise, and the line member 151 unwinds when the pulley 78 is rotated clockwise.

The lengths of the line members 150 and 151 which unwind from the pulleys 77 and 78 respectively when drawing the slingshot 1 are a multiplication of the lengths of line members 133 and 134 which wind around the shafts 76 and 77 respectively, the multiplication being the ratio of the diameters of the pulleys 77 and 78 to the shafts 76 and 77 respectively. This, in effect, increases the length of the draw to any length the user desires by changing the diameter of the pulleys 77 and 78, thus producing a draw which is most convenient for and comfortable to the user.

The flexible line members may be constructed of nylon rope, cotton rope, or other pliable material and in this example are woven steel airplane cable.

Figure 7:
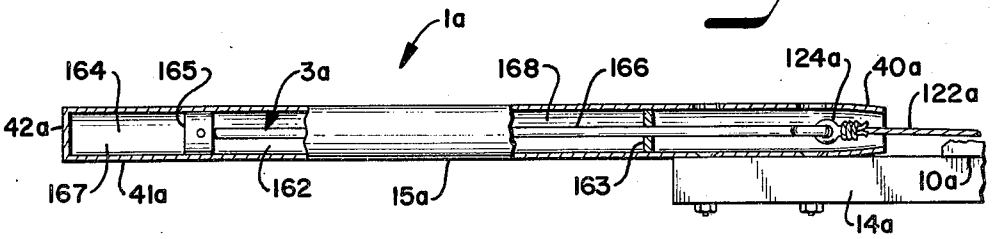
FIG. 7 is a fragmentary, side elevational view of an energy storing portion of another embodiment of the compound slingshot having a cylinder and plunger mechanism with portions broken away to show internal construction.

The reference numeral **1*a*, as seen in FIG. 7, generally represents another embodiment of the invention and includes a modified, elongate resilient means 3*a*. Since the compound slingshot 1*a* is otherwise substantially the same as the previously described device 1, similar parts appearing in FIG. 7 and FIGS. 1–6 respectively are represented by the same, corresponding reference numeral except for the addition of the suffix "a" to the numerals of the modified device. A frontwardly extending housing 15*a* is attached to the support beam 14*a* and is connected to the base 10*a* as in the previously described embodiment. The housing 15*a* has a forward end 41*a* and a rearward end 40*a*, and includes a cylinder portion 162 of substantially uniform interior diameter. The front end 41*a* of the cylinder 162 is covered by a cap 42*a*. A stop 163 of substantially the same diameter as the inside of the cylinder 162 is sealably mounted in the rear end 40*a* of the cylinder 162. Slidably mounted in the chamber 164 is a plunger or piston 165. The piston 165 is attached to one end of a rod 166 which is slidably and sealably mounted along the length of the rod 166 in the center of the stop 163. The other end of the rod 166 forms a hook which connects to an eyelet 124*a* on a line member 122*a*. The piston 165 divides the chamber 164 into a front portion 167 and a rear portion 168. In a rest position, the piston 165 is positioned near the cylinder front 42*a*, whereby the chamber's front portion 167 is relatively small and the rear portion 168 is relatively large. The pressure in the two chambers 167 and 168 is substantially equal to atmospheric in the rest position. When the piston 165 is moved to a position rearward of the rest position, a positive gauge pressure occurs in the rear chamber 168 and a negative pressure in the front chamber 167** thereby creating a forwardly directed force on the piston.

Figure 8:
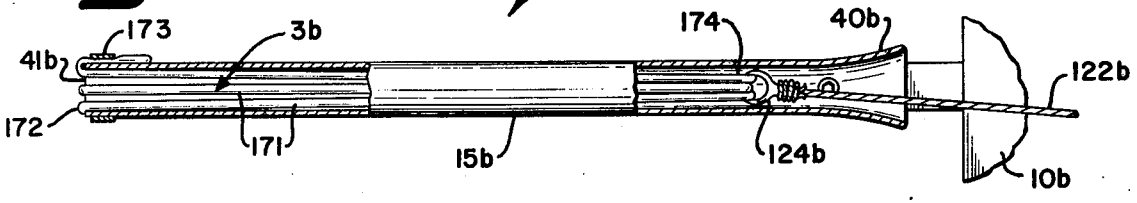
FIG. 8 is a fragmentary top plan view of an energy storing portion of another embodiment of the compound slingshot having a plurality of resilient bands with portions broken away to show internal construction.

The reference numeral **1*b* as seen in FIG. 8 generally represents a second modified embodiment of the invention, and in particular, a second modified elongate resilient means 3*b*. Since the compound slingshot 1*b* is otherwise substantially the same as the previously described device 1, similar parts appearing in FIG. 8 and FIGS. 1–6 respectively are represented by the same, corresponding reference numeral except for the addition of the suffix "b" to the numerals of the modified device. A housing 15*b* is connected to a base 10*b* and flanged at the rear 40*b* as previously described in the primary embodiment. A plurality of elastic or resilient bands 171 are contained in the housing 15*b* and one end 172 of each band 171 is attached to the housing front 41*b* by suitable means. In the embodiment illustrated the band ends 172 pass under a clamp 173 which secures the bands 171 to the housing front 41*b*. A second end 174 of each band 171 is tied or otherwise suitably attached to an eyelet 124*b* in a line member 122*b***. The elastic bands may be of any suitable material and in the embodiment illustrated are constructed of hollow, cylindrically shaped members, such as surgical tubing.

The reference numeral **1*c* (FIG. 9) generally represent a third modified embodiment of the invention having a modified projectile receiver 7*c*. Since the compound slingshot 1*c* is otherwise substantially the same as the previously described device 1, similar parts appearing in FIG. 9 and FIGS. 1–6 respectively are represented by the same, corresponding reference numeral except for the addition of the suffix "c" to the numerals of the modified device. A receiver 7*c* comprises a nocking point adapted for arrows or other elongate projectiles. A support plate 176 is mounted between the side panels 11*c* and 12*c* and is disposed substantially parallel to the base 10*c* and positioned at the top of and medially along the side panels. The plate 176 has upturned edges 177 positioned along the sides adjacent the support panels and is secured by these edges to the panels 11*c* and 12*c* by countersunk hexhead screws 180. The plate 176 is otherwise rectangular in shape and constructed of materials similar to the support 2*c*, and in this embodiment is an aluminum web. A rectangular strip of flexible plastic 178 is situated centrally on and affixed around its outer edges to the top of the plate 176. Two flaps 181 and 182 are cut in the plastic leaving the contiguous edge nearest the receiver 7c unsevered. The flaps 181 and 182 are rotated on their unsevered edges until they are disposed perpendicular to the plate 176 and then heat set to normally maintain this perpendicular position. The flaps 181 and 182 remain resilient returning to their original position parallel to the plate 176 when a small force is applied thereto. The first flap 181 is flat on the left side being adapted for supporting an arrow or other elongate projectile. The second flap 182 is positioned between flap 181 and the side panel 12c. The flap 182** is in the shape of a rectangular bar and also has a flat edge along the top being adapted for supporting arrows or other elongate projectiles.

In use, the compound slingshot 1 is held by the user such that the arm rest 110 braces against the top of his left forearm (or right forearm if left-handed), and his left hand grips the handle 13. Because the handle 13 is angled slightly rearwardly with respect to the vertical, a natural gripping action by the user will firmly brace the crossmember 117 of the rest 110 against the user's arm. Although the compound slingshot 1 may be used in a position wherein the base 10 is horizontal with respect to the ground, a position wherein the base is disposed vertically is normally preferred, especially when using elongate projectiles as will be discussed later. One of the sight brackets 108 or 109 is selected for use by the user in accordance with whether the user is right or left handed, and/or the slingshot will be held in the horizontal or vertical position. The pretension on the spring 36 is adjusted to correspond with the strength of the user by manipulation of the nut 47 on adjusting set screw 43. The device is now ready to be drawn and shot. The interaction which takes place can best be seen in the partially schematic diagram shown in FIG. 5. The solid lines represent the device in the rest position as previously described. To draw or cock the device, the user places a selected projectile onto the front surface of the receiver 7 and grasps the rear of the receiver 7 with his right-hand thereby folding the ends of the receiver 7 about the projectile and holding it in place. The user then applies force to the receiver 7 in a rearwardly direction by pulling on it, thus moving the receiver 7 rearward. The line portions 150 and 151 translate rearwardly with the receiver 7 and unwind from the pulleys 77 and 78 respectively thereby rotating the pulleys 77 and 78 and their attached shafts 75 and 76. The rotation of the shafts 75 and 76 winds the line members 133 and 134 around the shafts 75 and 76 respectively. The force applied to the line members 133 and 134 as they wind, is a multiplication of the force originally applied to the receiver by the user, and is directly related to the mechanical advantage created by the difference in the diameters of the pulleys 77 and 78 and the shafts 75 and 76 respectively. The multiplication factor is directly proportional to the ratio of the diameters of the pulleys to the shafts. As the line members 133 and 134 wind about the shafts 75 and 76, they unwind from the concentric pulley 51 of the cam 4. This unwinding rotates the cam 4 in a counterclockwise direction as seen by the phantom figures in FIG. 5. The maximum rotation of the illustrated cam 4 is 180°, which corresponds to a full draw of the receiver 7. As the cam 4 rotates, the line member 122 winds about the eccentric pulley 52. The force applied to the line member 122 varies during the draw and is equal (excluding frictional losses) to the combined forces applied to the line members 133 and 134 multiplied by the ratio of the radius of the concentric pulley 51 and a cam lever arm 187 (defined as the length of the imaginary line emanating from the axis of rotation of the cam 4 and perpendicularly intersecting the line member 122). In the rest position, the ratio of the radius of the pulley 51 to the lever arm 187 is less than 1 and therefore the mechanical advantage is actually negative. As the cam 4 rotates, the lever arm 187 becomes increasingly smaller, and at a partially drawn position, the mechanical advantage factor is equal to 1. As further rotation of the cam 4 occurs, the lever arm 187 becomes progressively smaller as the line member 122 gets closer to the axis of rotation of the cam 4, and because the radius of the pulley 51 is constant, the mechanical advantage factor increases accordingly. While the cam 4 is rotating, the line member 122 is transferring the force applied to the same to the spring 36. The spring 36 stores the energy association with the force applied thereto in the form of tension as the spring 36 is elongated. The energy stored in the spring 36 is substantially proportional to the distance it is elongated from its initial, pretensioned position. Thus, as seen in FIG. 5, most of the energy storage occurs during the first half of the draw. During the second half of the draw, a smaller additional amount of energy is stored in the spring 36 as tension. As previously discussed, the mechanical advantage due to the cam 4 is greatly increasing during the second half of the draw, thus, the force required of the user to hold or to move the receiver 7 backwards at or near the fully draw position is less than that which is required at some intermediate position. The energy stored in the spring 36 is fully available to be translated to the receiver 7, and thus the projectile, upon release of the receiver 7 by the user. Because the required force to draw is reduced near and at full draw, the user has much better control over the device, and his muscles are not under tension so as to wobble the compound slingshot.

Figure 9:
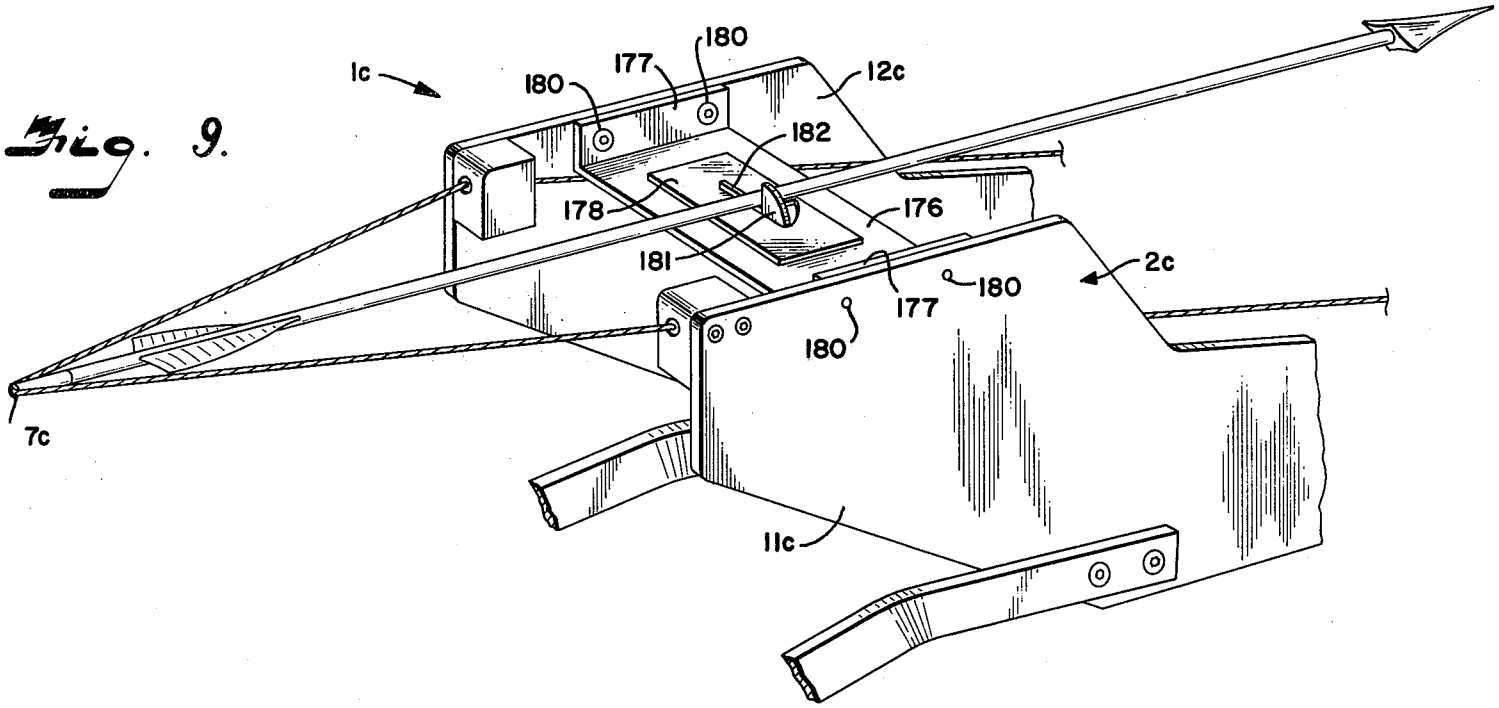
FIG. 9 is a fragmentary perspective view of another embodiment of the slingshot having a detachable support for elongate projectiles.

In use, the modified embodiments of the device as seen in FIGS. 7–9 function in a similar manner to the first described embodiment with the following exceptions. In the first modification 1a, energy is stored both as positive pressure on the back side of the piston 165, and as a negative pressure or vacuum on the front side of the same, as the piston 165 is moved rearwardly by the force applied to the line member 122a. In the second modification 1b, energy is stored as tension in elastic bands 171 in a manner very similar to the spring 36 of the primary embodiment. In the rest position pretension is adjusted in the second modification 1b by changing the length of the line member 122b and/or the bands 171. In the third modification 1c, the receiver pad 7 is replaced by the nocking point 7c and the support plate 176 is added. The flaps 181 and 182 are disposed in a vertical position, and an arrow or other elongate objects is rested upon the flat surfaces of the flaps 181 and 182. The nock of the arrow is inserted in the nocking point. When the arrow is shot the flaps 181 and 182 are adapted to bend forward in response to contact with a portion of the arrow, so as not to deflect the flight of the arrow. The device 1c otherwise functions as the compound slingshot 1.

It is to be understood that while I have illustrated and described certain forms of my invention, it is not to be limited to the specific forms or arrangement of parts herein described and shown.

What I claim and desire to secure by Letters Patent is:

1. An apparatus for hurling projectiles, said apparatus comprising:

(a) a longitudinally extending support, being rigid, and adapted for holding by a user;

(b) elongate energy storage means being longitudinally resilient, and having first and second ends; the first end of said energy storage means being connected with said support;

(c) a cam rotatably mounted on said support; said cam being operatively connected with the second end of said energy storage means whereby selected cam rotation elongates and tenses said energy storage means;

(d) a projectile receiver operatively connected with said cam whereby rearward translation of said receiver, substantially parallel to the longitudinal axis of the support, with respect to said support rotates said cam and applies tension to said energy storage means such that the force required to retain said receiver at a fully extended position is less than the force required to retain said receiver at an intermediate position; and (e) mechanical advantage means operably connected between said cam and said projectile receiver, whereby pulling force applied to said receiver is multiplied in the tension applied to said cam.

2. An apparatus as set forth in claim 1 wherein:

(a) said cam is rotatably mounted at a point on said support and has a marginal surface thereof disposed eccentrically with respect to said point; and including (b) a flexible line member having a first end thereof connected directly with the second end of said energy storage means, and a second end thereof connected with the marginal surface of said cam and convoluted thereabout.

3. An apparatus for hurling projectiles, said apparatus comprising:

(a) a longitudinally extending support adapted for holding by a user;

(b) elongate resilient means having first and second ends; the first end of said resilient means being connected with said support;

(c) a cam rotatably mounted on said support; said cam being operatively connected with the second end of said resilient means whereby selected cam rotation elongates and tenses said resilient means;

(d) a projectile receiver operatively connected with said cam whereby rearward translation of said receiver with respect to said support rotates said cam and applies tension to said resilient means such that the force required to retain said receiver at a fully extended position is less than the force required to retain said receiver at an intermediate position;

(e) said cam is rotatably mounted at a point on said support and has a marginal surface thereof disposed eccentrically with respect to said point; and including (f) a flexible line member having a first end thereof connected with the second end of said resilient means, and a second end thereof connected with the marginal surface of said cam and convoluted thereabout;

(g) said flexible line member constitutes a first flexible line member; and including (h) a second flexible line member having a medial portion thereof connected with said receiver, and first and second ends thereof each being connected with the marginal surface of said cam and each being convoluted thereabout in a direction opposite to said first flexible line member, whereby rearward translation of said second flexible line member medial portion translates said first flexible line member and tenses said resilient means.

4. An apparatus as set forth in claim 3 including:

(a) a pulley attached to said cam and rotating therewith; said pulley having a substantially cylindrically shaped marginal surface disposed concentrically with said point; and wherein (b) each of said second flexible line member first and second ends being connected with the marginal surface of said pulley and being convoluted thereabout in the same direction whereby rearward translation of said second flexible line member medial portion translates said first flexible line member and tenses said resilient means.

5. An apparatus as set forth in claim 4 including:

(a) means operatively connected between said cam and said receiver and having a mechanical advantage, whereby the tension applied to said resilient means for a given pulling force upon said receiver is multiplied.

6. An apparatus as set forth in claim 5 wherein said means having a mechanical advantage comprises:

(a) first and second shafts each being rotatably mounted in said support on opposite sides thereof;

(b) first and second reels concentrically attached to an upper end of said first and second shafts respectively and rotating therewith; said first and second reels each having a cylindrically shaped outer surface, with the first and second ends of said second flexible line member attached respectively thereto;

(c) third and fourth flexible line members each having first and second ends; the second end of each of said third and fourth flexible line members being attached to the marginal surface of said pulley and convoluted thereabout in the same direction; the first end of said third and fourth flexible line members being connected with and wrapped about a lower end of said first and second shaft respectively, whereby rearward translation of said receiver rotates said reels and said cam, and applies tension to said resilient means with a mechanical advantage.

7. An apparatus as set forth in claim 6 including:

(a) a body rest attached to said support; said rest being contoured and padded to brace against an arm of a user, whereby the user has more leverage and greater steadiness in sighting.

8. An apparatus for hurling projectiles, said apparatus comprising:

(a) a longitudinally extending support adapted for holding by a user;

(b) elongate resilient means having first and second ends; the first end of said resilient means being connected with said support;

(c) a cam rotatably mounted on said support; said cam being operatively connected with the second end of said resilient means whereby selected cam rotation elongates and tenses said resilient means;

(d) a projectile receiver operatively connected with said cam whereby rearward translation of said receiver with respect to said support rotates said cam and applies tension to said resilient means such that the force required to retain said receiver at a fully extended position is less than the force required to retain said receiver at an intermediate position;

(e) said cam is rotatably mounted at a point on said support and has a marginal surface thereof disposed eccentrically with respect to said point; and including (f) a flexible line member having a first end thereof connected with the second end of said resilient means, and a second end thereof connected with the marginal surface of said cam and convoluted thereabout;

(g) said flexible line member constitutes a first flexible line member; and including (h) a pulley attached to said cam and rotating therewith; said pulley having a substantially cylindrically shaped marginal surface disposed concentrically with said point; and (i) a second flexible line member having a medial portion thereof connected with said receiver, and first and second ends thereof each being connected with the marginal surface of said pulley and each being convoluted thereabout in the same direction whereby rearward translation of said second flexible line member medial portion translates said first flexible line member and tenses said resilient means.

9. An apparatus as set forth in claim 8 including:

(a) first and second shafts each being rotatably mounted in said support on opposite sides thereof (b) first and second reels concentrically attached to an upper end of said first and second shafts respectively and rotating therewith; said first and second reels each having a cylindrically shaped outer surface, with the first and second ends of said second flexible line member attached respectively thereto;

(c) third and fourth flexible line members each having first and second ends; the second end of each of said third and fourth flexible line members being attached to the marginal surface of said pulley and convoluted thereabout in the same direction; the first end of said third and fourth flexible line members being connected with and wrapped about a lower end of said first and second shaft respectively, whereby rearward translation of said receiver rotates said reels and said cam, and applies tension to said resilient means with a mechanical advantage.

10. An apparatus for hurling projectiles, said apparatus comprising:

(a) a longitudinally extending support, being rigid, and adapted for holding by a user;

(b) elongate energy storage means being longitudinally resilient, and having first and second ends; the first end of said energy storage means being connected with said support;

(c) a cam rotatably mounted on said support at a point, and including a marginal surface thereof disposed eccentric with respect to said point;

(d) a flexible line member having a first end thereof connected directly to the second end of said energy storage means, and a second end thereof connected with the marginal surface of said cam, whereby selected cam rotation longitudinally elongates and tenses said energy storage means;

(e) a projectile receiver operatively connected with said cam whereby rearward translation, substantially parallel to the longitudinal axis of the support, of said receiver with respect to said support rotates said cam thereby applying tension to said energy storage means such that the force required to retain said receiver at a fully extended position is less than the force required to retain said receiver at an intermediate position, and (f) mechanical means adjacent said cam for permitting multiplication of the force applied to the receiver.

* * * * *